United States Patent [19]

Curchod et al.

[11] 3,978,313

[45] Aug. 31, 1976

[54] POWER REGULATING ARRANGEMENT FOR A THREE PHASE ELECTRODE-TYPE WATER HEATER

[76] Inventors: Albert Curchod, Chemin des Roches, 1803 Chardonne, Switzerland; Aimé Luporini, Le Vergeron, 83420 La Croix Valmer, France

[22] Filed: Feb. 28, 1975

[21] Appl. No.: 554,028

[30] Foreign Application Priority Data

Mar. 5, 1974 Switzerland ..... 3124/74

[52] U.S. Cl. ..... 219/285; 219/289; 219/291; 219/292; 219/295; 338/85

[51] Int. Cl.[2] ..... H05B 3/60; H01C 10/02

[58] Field of Search ..... 219/284–295, 219/271–276; 338/80–86

[56] References Cited

UNITED STATES PATENTS

| | | | |
|---|---|---|---|
| 1,201,707 | 10/1916 | Dorgeloh | 338/84 |
| 1,431,580 | 10/1922 | Graetzer et al. | 219/284 |
| 1,677,299 | 7/1928 | Schneider | 219/285 |
| 1,706,146 | 3/1929 | Davidsen | 219/286 |
| 2,398,136 | 4/1946 | Drabble et al. | 219/285 |
| 2,649,526 | 8/1952 | Benchemoul | 338/84 |
| 2,748,232 | 5/1956 | Rubega | 338/85 X |
| 3,796,857 | 3/1974 | Henley et al. | 219/285 |
| 3,873,807 | 3/1975 | Mohr | 219/285 |
| 3,931,530 | 1/1976 | Davis et al. | 219/288 X |

FOREIGN PATENTS OR APPLICATIONS

| | | | |
|---|---|---|---|
| 992,551 | 7/1951 | France | 219/285 |
| 779,078 | 1/1935 | France | 219/288 |
| 92,636 | 1/1922 | Switzerland | 219/285 |

*Primary Examiner*—A. Bartis
*Attorney, Agent, or Firm*—Robert E. Burns; Emmanuel J. Lobato; Bruce L. Adams

[57] ABSTRACT

A water heater has a pair of concentric, relatively rotatable, electrically insulating supports between which the water to be heated can pass. Each support mounts three parts of equidistantly spaced electrodes. The spaced electrodes of the first set are electrically connected in pairs and each pair is connected to a respective phase of a regulatable three-phase current supply by connection means which may include a thyristor. The spaced electrodes of the second set are electrically connected together exclusively in pairs. The sets of electrodes are spaced from each other and the water flowing therebetween provides conductive paths so that the first and second sets of electrodes are connected in a delta configuration. Means are provided to rotate one of the supports to change the relative position of the electrode sets relative to each other thereby regulating the current flow through the water.

7 Claims, 6 Drawing Figures

POWER REGULATING ARRANGEMENT FOR A THREE PHASE ELECTRODE-TYPE WATER HEATER

BACKGROUND OF THE INVENTION

The present invention relates to a water heater having immersed electrodes, in which the water is heated by resistance by the electric current flowing between the electrodes, this water heater comprising at least three electrodes connected in a delta configuration to a source of three-phase current and means for regulating the current.

It has already been proposed to produce a water heater of this type in German Pat. No. 356,288, the electrodes being mounted radially and symmetrically on an insulating support. The use of a three-phase current makes it possible to obtain a more favourable electric coefficient than with single-phase current consequently a greater efficiency.

In order that an installation of this type may be used practically, it is nevertheless necessary to be able to regulate the current consumed, not only depending on requirements, i.e. the desired temperature, but also depending on the admissible current intensity in a domestic supply system, taking into account the fact that this admissible intensity may also vary depending on other needs. Electrical regulating devices using circuit-breakers cut the supply current when the desired temperature of the water or ambient temperature is reached. However, this all or nothing operation is incompatible with domestic use under normal conditions, since sudden current variations, which are of the order of 25 amperes are not acceptable, taking into account the consumption of such an installation, in a domestic supply system without disturbing the latter.

Electronic regulating means such as thyratrons or triacs making it possible to keep the current at a constant value are currently available to the man skilled in the art. If the introduction of such a member into the supply circuit of the electrodes does not cause any problems in the case of a single-phase supply, this is not the case when there are three electrodes connected in a delta connection, as is the case of a water heater having immersed electrodes supplied with three-phase current, since if there is a thyratron or triac for each phase, the first of these members to open, allows a current equal to the sum of the currents in the two other members to pass, according to the law of feeding-points, which has the effect of putting the system out of equilibrium by modifying the angles of the currents in each of the phases. Furthermore, the resistivity of the water may vary greatly from one source to another, these variations completely modifying the working conditions and in particular the consumption of current and the heating time.

SUMMARY OF THE INVENTION

It is the object of the present invention to acheive an operation at a desired intensity, whatever the temperature and nature of the fluid, in order to provide greater flexibility in the regulation phase.

The water heater according to the invention is characterised by the fact that it comprises a first support of insulating material, to which are fixed three pairs of equidistantly spaced heating electrodes, each pair being connected to one phase of the supply source, a second support of insulatng material, arranged opposite and at a constant distance from the first support, to which are fixed three pairs of equidistantly spaced heating electrodes connected to each other exclusively in pairs by a conductor, the space between the supports defining a chamber through which the water to be heated passes and one of the supports being able to move with respect to the other in order to be able to modify the relative position of the electrodes and the current flowing between the electrodes of the fixed support and the electrodes of the movable support.

The supports are advantageously constituted by concentric cylinders, but could have other shapes, in particular the shape of flat parallel supports.

The accompanying drawing illustrates, as a non-limiting example, one embodiment of the invention.

Figure 1:
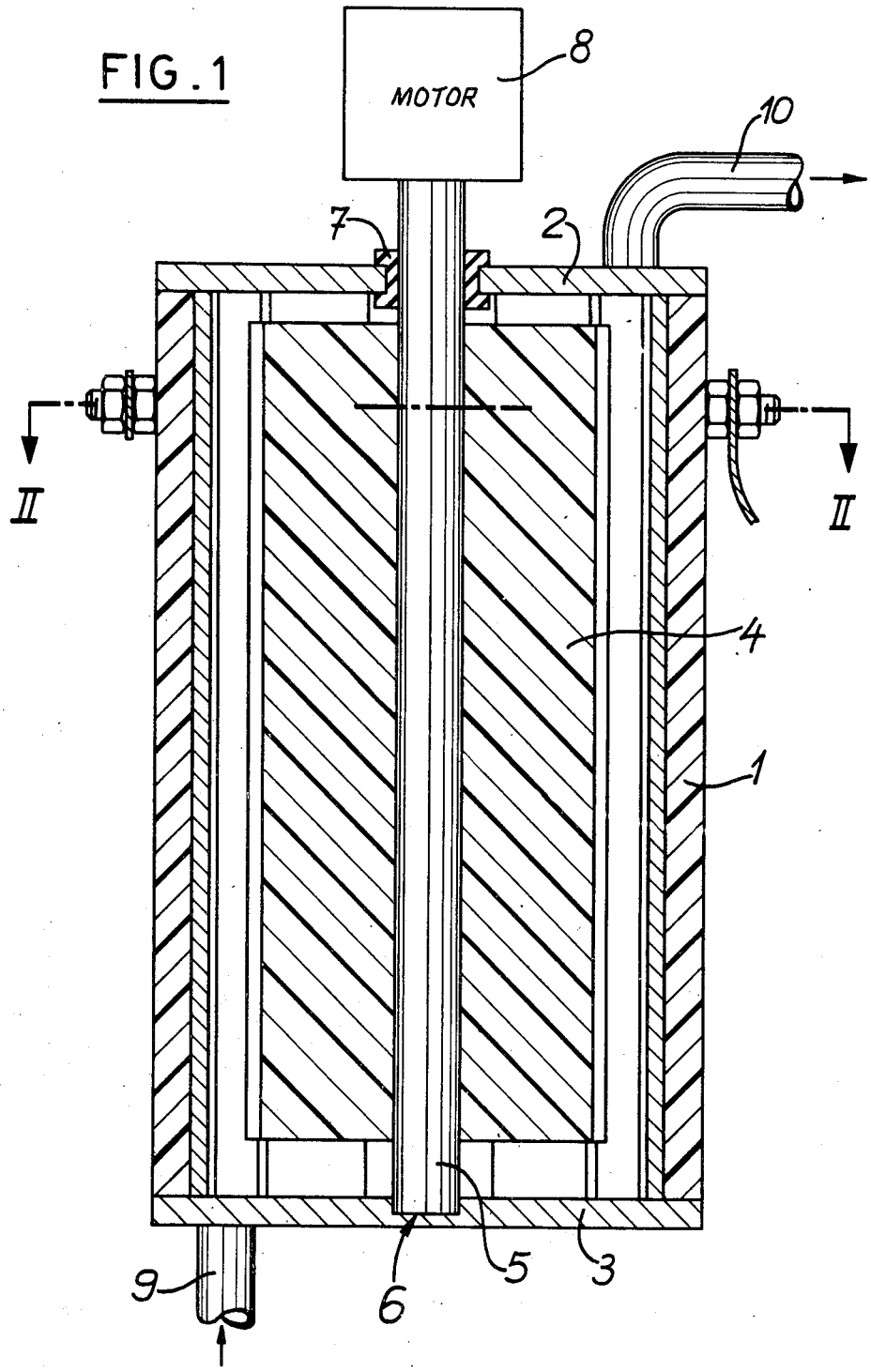
FIG. 1 shows a diagrammatic view thereof in elevation and axial section.

The water heater illustrated in the drawings comprises an outer hollow cylinder 1 of electrically insulating material, closed at its ends by two side-plates 2 and 3, preferably made of metal, but which may also be of synthetic material. Mounted inside the cylinder 1 is a solid cylinder 4, also of insulating material, mounted on a shaft 5 preferably made from metal. The lower end of this shaft 5 is freely engaged in a circular housing 6 in the side-plate 3 in order to be able to rotate in this housing, which serves as a bearing. The upper part of the shaft 5 passes through the side-plate 2 through a gasket 7 and it is connected to a motor 8 by means of which the inner cylinder 4 may be rotated slowly to be brought into the desired position with respect to the outer cylinder 1. The side-plates 2 and 3 are fixed in a tight manner to the cylinder 1 by sticking or bolting, with the interposition of a gasket if necessary. The water enters the cylinder 1 through an inlet pipe 9 and leaves the latter at the upper end through an outlet pipe 10.

Figure 2:
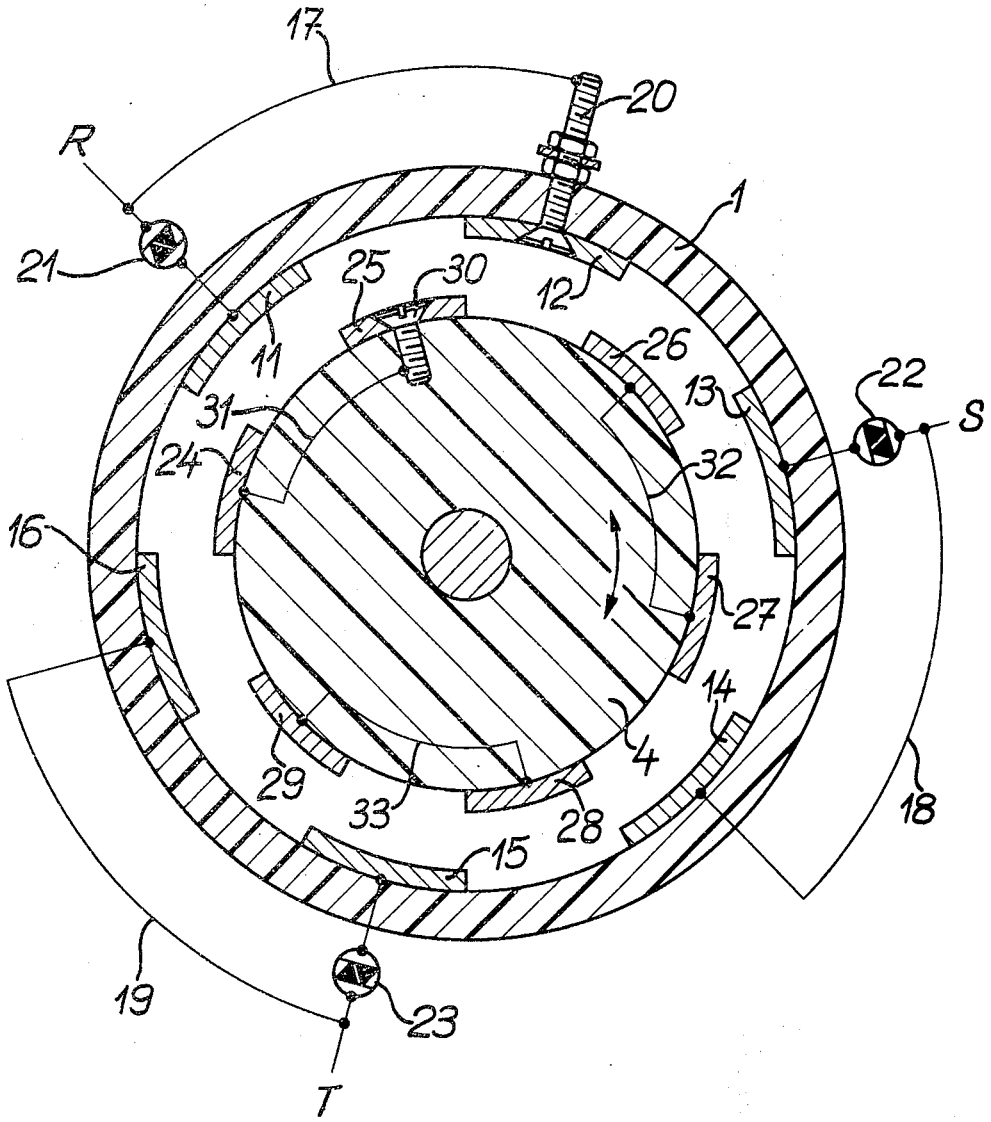
FIG. 2 shows a diagrammatic view thereof in section on line II—II of FIG. 1.

Reference will now be made to FIG. 2. Three pairs of electrodes 11/12, 13/14 and 15/16 are fixed to the inner wall of the cylinder 1. The electrodes of each pair are interconnected externally and galvanically by metal bars 17, 18 and 19 respectively. The electrodes are secured by any adequate means, for example by bolts 20. The electrodes 11, 13 and 15 are connected to the phases R,S and T of a regulatable three-phase current source by thyristors 21, 22 and 23 respectively. The electrodes 11 to 16 are in the shape of segments of cylindrical walls.

Three pairs of electrodes 24/25, 26/27 and 28/29, of the same shape as the electrodes 11 to 16, are also secured to the inner cylinder 4. These electrodes are fixed by means of screws 30 for example and electrodes of each pair are interconnected galvanically by conductors 31, 32 and 33 respectively. These conductors are not necessarily insulated from the water located between the cylinders 1 and 4.

It is appropriate to stress that these thyristors are not indispensable, as will become apparent from the description of the operation in relation to FIGS. 3 to 6, in which the thyristors have been eliminated.

Figure 3:
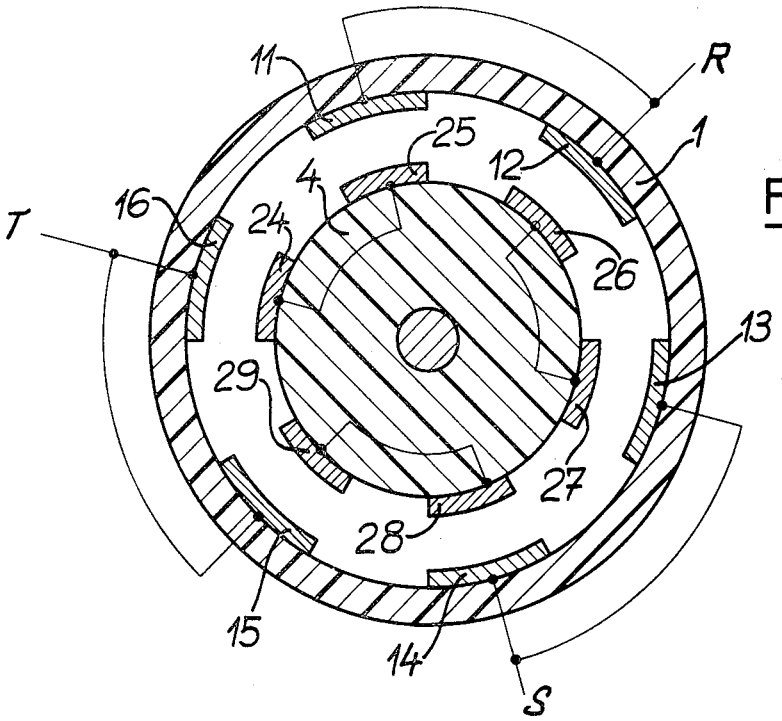
FIG. 3 shows diagrammatically the position of the electrodes in which the current is maximum.

The operation of the water heater is as follows:

Since the water is cold, for example at a temperature of 11°C, the inner cylinder 4 is brought into the position shown in FIG. 3, in which the electrode 25 is opposite the electrode 11, the electrode 26 opposite the electrode 12 etc. The inner electrodes to some extent bridge the outer electrodes, such that the electric triangle is closed along the path 12-26-27-13-14-28-29-15-16-24-25-11. In this position the current is a maximum, for example 20 amperes.

Figure 4:
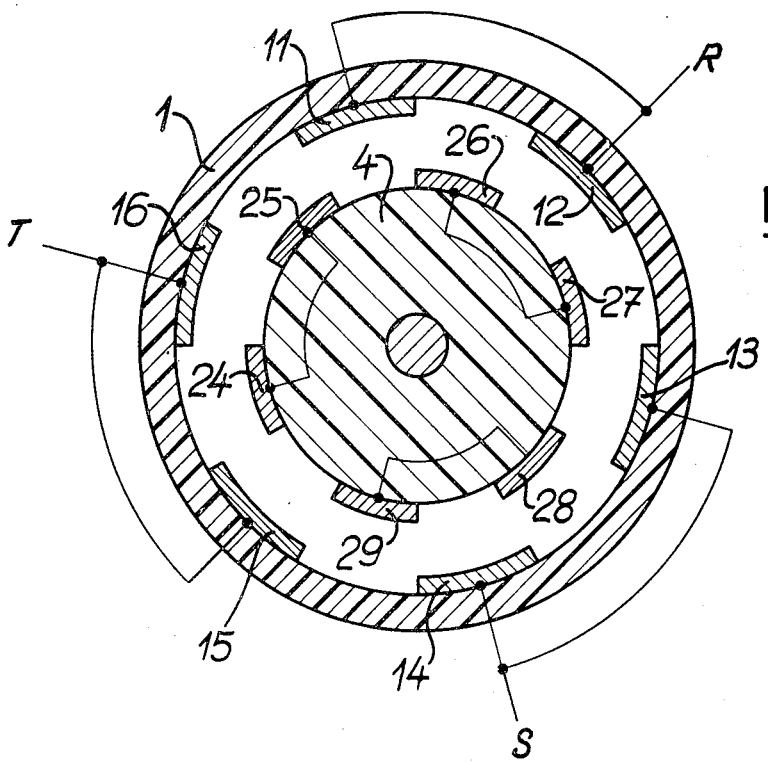
FIG. 4 shows a possible position of the electrodes in which a minimum current makes it possible to maintain a temperature which has been reached.
Figure 5:
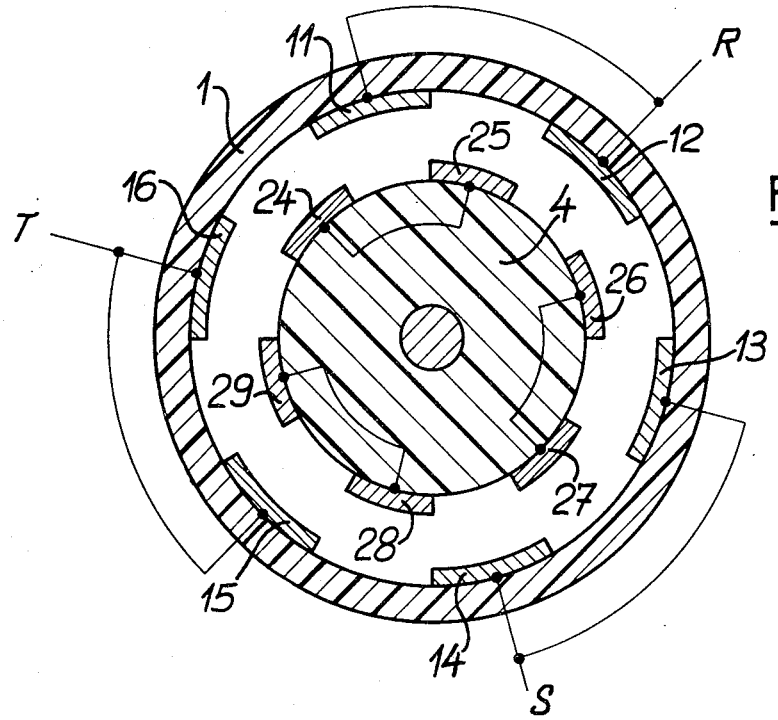
FIG. 5 shows a variation of the position illustrated in FIG. 4, making it possible to obtain the same minimum current.

The temperature of the water increases and the current also. In order to maintain the desired maximum current of 20 amperes for example, the cylinder 4 is rotated in one direction or the other until the desired temperature is reached, for example 60°C. FIG. 4 shows an example of minimum current for maintaining the temperature indicated, obtained by rotating the cylinder 4 in counter-clockwise direction, whereas FIG. 5 shows another position in which the minimum current is the same, obtained by rotation of the cylinder 4 in clockwise direction.

Figure 6:
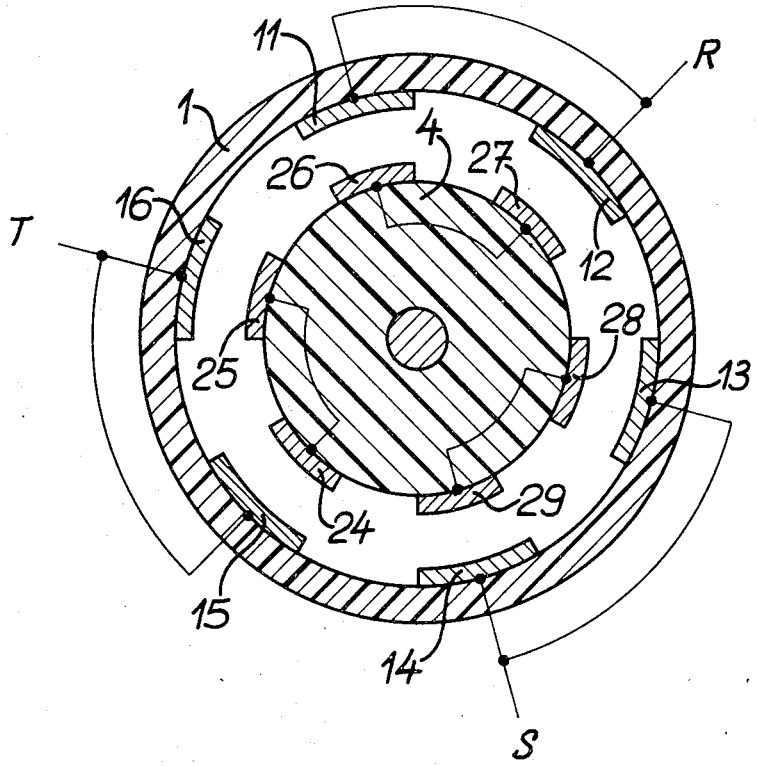
FIG. 6 shows the inoperative position in which the current is virtually zero.

In the relative position of the electrodes shown in FIG. 6 there is no current flow therebetween.

Regulation takes place automatically by means of a thermostat and current measuring device, for example a parametric resistance controlling means for controlling and driving the servo-motor 8.

If thyristors are used for limiting the maximum current, it is possible to leave the electrodes in the position illustrated in FIG. 3 until the temperature indicated is reached, the electrodes then being brought into the position for minimum current. It is also possible to combine the two methods, the thyristors intervening solely to maintain the current in the region of the predetermined value.

It is not absolutely necessary for the insulating supports of the electrodes to be in the shape of concentric cylinders. In fact, it is sufficient if the supports remain parallel to each other and at a constant distance from each other during their relative displacement. Thus, the electrodes could be fixed to two flat parallel supports, the regulation taking place by moving one of the supports in its plane, either by translation if the electrodes are distributed in a linear manner, or rotation, if the electrodes are distributed in a circular manner about the axis of rotation, in this latter case, the supports being in the form of parallel discs.

What is claimed is:

1. A water heater comprising, means defining a chamber for containing water therein for heating, a first set of heating electrodes comprising three pairs of equidistantly spaced electrodes in fixed spaced relationship to each other and electrically connected in pairs, connections connecting each pair of said first set of electrodes to a respective phase of a regulatable three-phase current source externally of said chamber, a second set of heating electrodes comprising three pairs of equidistantly spaced electrodes in said chamber in fixed spaced relationship to each other inwardly from the first set of electrodes, conductors electrically connecting the second set of electrodes exclusively in pairs, said chamber containing water in operation providing conductive paths so that the sets of heating electrodes are connected in a delta configuration with said water defining resistive electrical paths, and means to move the one set of heating electrodes relatively to the other set of heating electrodes to change the distance therebetween thereby to vary the length of said electrical paths.

2. A water heater according to claim 1, in which said first set of heating electrodes are arranged circularly spaced and said heating electrodes of said second set of heating electrodes are arranged circularly spaced and disposed concentric with the first set of heating electrodes.

3. A water heating according to claim 2, in which said means to move one set of electrodes comprises means to move one set of electrodes in a circumferential direction of rotation.

4. A water heater according to claim 3, in which said means defining said container comprises a cylindrical member made of electrically insulative material the first set of electrodes, and an electrically insulative core of circular cross section in said cylindrical mounting the second set of heating electrodes.

5. A water heater according to claim 4, in which means to move one set of heating electrodes comprises means to rotate said core.

6. A water heater according to claim 1, in which said connections connecting each pair of said first set of electrodes to a respective phase of three-phase current source each comprise a thyristor.

7. A water heater according to claim 1, in which said connections connecting each pair of said first set of electrodes to a respective phase of three-phase current source comprise a triac.

* * * * *